US008141745B2

(12) United States Patent
Hefele et al.

(10) Patent No.: US 8,141,745 B2
(45) Date of Patent: Mar. 27, 2012

(54) EJECTION DEVICE

(75) Inventors: Christian Hefele, Breitenbrunn (DE); Rainer Strobel-Schmidt, Bad Woerishofen (DE); Ingo Loeschky, Kaufering (DE); Franz Heiberger, Stettfurt (CH); Peter Ostermeier, Diessen (DE)

(73) Assignee: Hilti Aktiengesellschaft, Schaan (LI)

( * ) Notice: Subject to any disclaimer, the term of this patent is extended or adjusted under 35 U.S.C. 154(b) by 437 days.

(21) Appl. No.: 12/287,641

(22) Filed: Oct. 10, 2008

(65) Prior Publication Data

US 2009/0095772 A1 Apr. 16, 2009

(30) Foreign Application Priority Data

Oct. 15, 2007 (DE) ..... 10 2007 000 502

(51) Int. Cl.
*B67D 7/70* (2010.01)

(52) U.S. Cl. ..... 222/137; 222/333

(58) Field of Classification Search ..... 222/326, 222/327, 333, 386, 135–137, 94–102; 74/442, 74/89, 89.16, 89.17, 89.11
See application file for complete search history.

(56) References Cited

U.S. PATENT DOCUMENTS

| | | | | |
|---|---|---|---|---|
| 3,635,378 | A * | 1/1972 | DeHart | 222/333 |
| 3,854,629 | A * | 12/1974 | Blieberger | 222/109 |
| 4,516,696 | A * | 5/1985 | Eknor | 222/181.2 |
| 4,793,521 | A * | 12/1988 | Steiner | 222/156 |
| 4,986,454 | A * | 1/1991 | Riley | 222/327 |
| 5,358,145 | A * | 10/1994 | Smith et al. | 222/137 |
| 5,503,307 | A * | 4/1996 | Wilson et al. | 222/326 |
| 6,101,968 | A * | 8/2000 | Fitzgibbons et al. | 118/14 |
| 6,540,113 | B2 * | 4/2003 | Gardos | 222/137 |
| 6,889,872 | B2 * | 5/2005 | Herman et al. | 222/82 |
| 2007/0251957 | A1 * | 11/2007 | Chen | 222/386 |
| 2009/0052970 | A1 * | 2/2009 | Jung | 401/152 |

FOREIGN PATENT DOCUMENTS

DE 29804402 U1 * 5/1998

OTHER PUBLICATIONS

DE 298 04 402 abstract and english translation of p. 3, lines 6-11.*

* cited by examiner

*Primary Examiner* — Kevin P Shaver
*Assistant Examiner* — Robert Nichols, II
(74) *Attorney, Agent, or Firm* — Abelman, Frayne & Schwab

(57) ABSTRACT

An ejection device for a mass-containing package (12) includes at least one piston rod (16) having a toothing (17) extending along its longitudinal extent, and a drive unit (21; 41) for displacing the at least one piston rod (16) and having at least one gear wheel (24; 44) engageable with the toothing (17) of the at least one piston rod (16) and displaceable from a first position, in which it engages the toothing (17) of the at least one piston rod (16), to a position in which it is disengaged from the toothing (17) of the at least one piston rod, and a drive motor (22) for driving the at least one gear wheel (24; 44).

4 Claims, 2 Drawing Sheets

EJECTION DEVICE

BACKGROUND OF THE INVENTION

1. Field of the Invention

The present invention relates to an ejection device for a mass-containing package including at least one piston rod having a toothing extending along a longitudinal extent of the piston rod, and a drive unit for displacing the at least one piston rod and including at least one gear wheel engageable with the toothing of the at least one piston rod, and a drive motor for driving the at least one gear wheel.

2. Description of the Prior Art

An ejection device of the type described, which is also called a rack dispenser, is used for forcing out from a package such as, e.g., a film bag or a cartridge, the mass, which is packaged therein, at the mass application site. The ejection devices of this type are suitable for forcing out from a package different types of masses, such as, e.g., mortar mass or sealing mass. Upon actuation of the drive motor, the piston rod is pushed a predetermined amount, so that a pressure plate, which is arranged on the piston rod, acts on the package, and a corresponding amount of the mass enclosed in the package, is forced out through an outlet opening in the head portion of the ejection device. For changing the package, from which the mass contained therein has to be ejected, the piston rod should be withdrawn in order to be able to remove the spent package from the ejection device and replace it with another package.

German Publication DE 22 27 930 A1 discloses an ejection device of the above-described type and including piston rod having a toothing extending along a longitudinal extent of the piston rod, and a drive unit for displacing the piston rod and including a gear wheel engageable with the toothing of the piston rod, and drive means, which is formed of a motor and a gear unit, for driving the gear wheel.

The displaced piston rod is returned in its initial position by reversal the motor pols. After the piston rod has been returned to its position, the located in the ejection device, spent package is removed, and a new package is placed into the ejection device.

The drawback of the ejection device which is disclosed in DE 22 27 930 A1, consists in that the return of the piston rod in its initial position is time-consuming.

An ejection device is also disclosed in German Publication DE 35 35 291 A1. In this ejection device, the toothing of the piston rod is disengaged from the gear wheel by rotating the piston rod about its longitudinal axis. This provides for a free displacement of the piston rod.

The drawback of the ejection device of DE 35 35 229 A1 consists in that the disengagement of the piston rod from the gear wheel is rather sluggish and is associated with high wear of the components.

Accordingly, an object of the present invention is to provide an ejection device of the type described above in which a simple and low-wear disengagement of the gear wheel form the piston rod is possible.

SUMMARY OF THE INVENTION

This and other objects of the present invention, which will become apparent hereinafter, are achieved by providing an ejection device in which the at least one gear wheel is displaced from a first position, in which the gear wheel engages the toothing of the at least one piston rod, into a position in which the gear wheel is disengaged from the toothing of the at least one piston rod.

The drive chain from the drive motor to the at least one piston rod is broken by displacement of the at least one gear wheel, and the at least one piston rod can be freely displaced. Because the gear wheel is displaced, the wear, which takes place upon breaking and linking of the drive chain, is substantially reduced in comparison with the ejection device of DE 35 35 229 A1.

In addition, no secondary impacts take place between the gear wheel, which engages the toothing of the at least piston rod, and the at least one piston rod. Advantageously, the drive unit is displaceable together with the at least one gear wheel to provide for engagement and disengagement of the at least one gear wheel with and from the toothing of the at least one piston rod, respectively. This insures an easy operation of the ejection device. The drive chain from the drive motor to the at least one piston rod is broken by displacement of the entire drive unit, which insures a free displacement of the at least one piston rod.

Advantageously, the drive unit has a rotational axis which extends parallel to a rotational axis of the at least one gear wheel and about which the drive unit rotates. The rotational axis of the drive unit advantageously extends transverse to the ejection direction of the ejection device. With the rotation of the drive unit, together with the at least one gear wheel, the at least one gear wheel becomes disengaged from the toothing of the at least one piston rod. The at least one piston rod becomes freely displaceable and can be easily pulled back or displaced. Finally, upon rotation of the drive unit in a direction opposite the direction in which the drive unit rotates for disengaging the gear wheel from the at least one piston rod, the at least one gear wheel is again brought into engagement with the toothing of the at least one piston rod.

With the at least one gear wheel pivoting out of and into engagement with the toothing of the at least one piston rod, no wear occurs between these components upon their engagement and disengagement because the advantageously pointed tooth tips of the gear wheel and of the toothing of the at least one piston rod find themselves upon pivoting of the components into engagement with each other.

According to an alternative embodiment of the inventive ejection device, the at least one gear wheel is axially displaced along its rotational axis. Advantageously, the at least one gear wheel which is axially displaced transverse to the longitudinal extent of the toothing of the at least one piston rod. In this position of the drive unit, the at least one piston rod is freely displaceable and can be easily pulled back or be displaced. E.g., the at least one gear wheel can be displaced with a lever along a gear wheel shaft in the direction of the rotational axis of the at least one gear wheel. The shaft need not necessarily be linear.

According to a further advantageous embodiment of the present invention, for disengagement of the at least one gear wheel from the toothing of the at least one piston rod, the drive unit, together with the at least one gear wheel, is axially displaced.

Advantageously, there is provided an actuation member for displacing the at least one gear wheel and which enables an easy displacement of the at least one gear wheel by the user. This is applicable also to an advantageous embodiment according to which the drive unit, together with the at least one gear wheel, is displaced.

E.g., with a rotatably displaceable drive unit, there is provided, on the housing of the drive unit, a handle-shaped projection extendable along the rotational axis of the drive unit. The projection, e.g., is manually operable, so that the user can hold the ejection device with the hand that actuates the actuation member, and with the other hand can position the now freely movable, at least one piston rod.

With the at least one, axially displaceable, gear wheel, e.g., a toggle lever is provided with which the at least gear wheel is disengaged from the toothing of the at least one piston rod. With this embodiment also, the user can hold the ejection device with the hand that actuates the actuation member, and with the other hand can positioned the now freely movable, at least one piston rod.

Advantageously, the at least one gear wheel is displaced against a biasing force of a spring and after displacement, is against biased by the spring in the position in which the at least one gear wheel engages the toothing of the at least one piston rod. With the rotatably displaceable drive unit, the spring is formed, e.g., as a torsion spring. With an axially displaceable gear wheel or axially displaceable drive unit, which is displaced together with the gear wheel, the spring is formed, e.g., as a tension spring in form, e.g., of a helical spring.

Advantageously, there is provided a locking lever for retaining the at least one gear wheel in a position in which the gear wheel is disengaged from the piston rod. The locking lever mechanically secures the at least one gear wheel in its disengaged position. Therefore, the user need not retain the at least one gear wheel, directly or indirectly in its disengaged position when handling the entire ejection device. The locking lever is provided, e.g., on the outer housing of the ejection device and engages, in its locking position, in corresponding receptacle formed in the at least one gear wheel or, with a displaceable drive unit, in a corresponding receptacle provided on the drive unit or a housing part.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
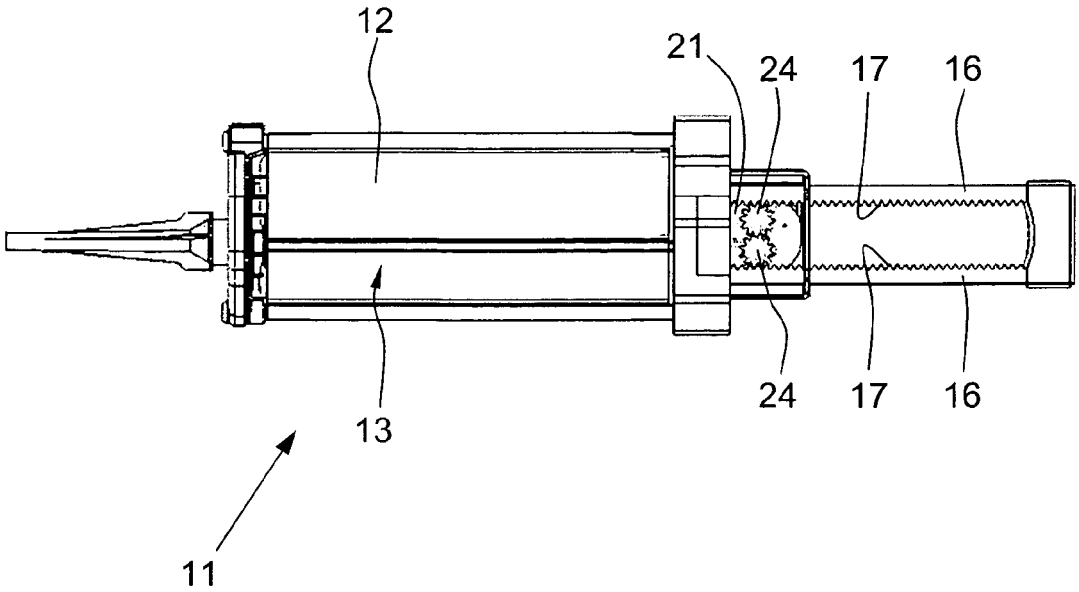
FIG. 1 a plan view of a first embodiment of an ejection device according to the present invention.

In the following description of the embodiments shown in the drawings, in which the identical parts are designated with the same reference numerals, reference will be made to a displaceable drive unit with at least one gear wheel. The embodiments, which will be described below, refer to an ejection device in which the only at least one gear wheel is displaced from a first position, in which the at least one gear wheel engages the toothing of at least one piston rod, to a position in which the at least one gear wheel is disengaged from the toothing of the at least one piston rod.

Figure 2:
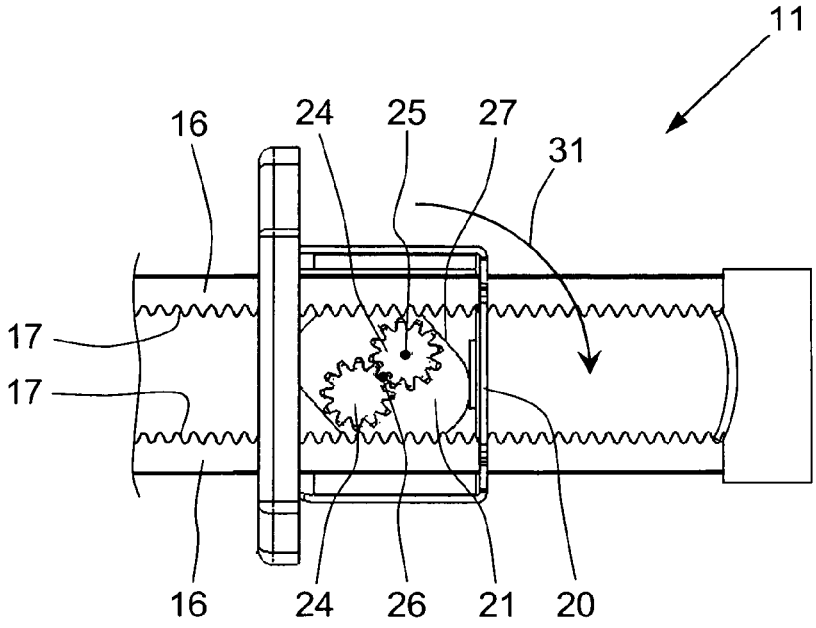
FIG. 2 a plan view of a detail of a disconnected drive unit of the device shown in FIG. 1.
Figure 3:
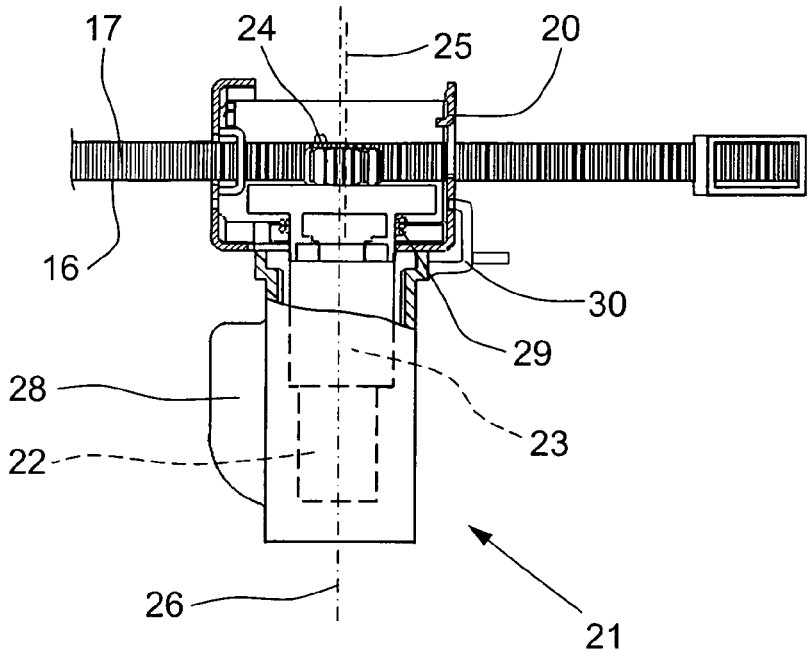
FIG. 3 a side, partially cross-sectional view of the detail shown in FIG. 2.

An ejection device 11, which is shown in FIGS. 1-3, is designed for pressing a mass from a package 12 that is replaceably received in a receiving chamber 13 of the ejection device 11. The ejection device 11 has two piston rods 16 each provided with a toothing 17 along its longitudinal extent, with the toothings 17 of both piston rods 16 facing each other. The ejection device 11 further has a drive unit 21 for the piston rods 16.

The drive unit 21 includes a drive motor 22 formed as an electric motor, a transmission gear 23, and two gear wheels 24 driven by the drive motor 22. The gear wheels 24 engage each other and respective toothings 17 of the piston rods 16.

The drive unit 21 has a rotational axis 26 which extends parallel to the rotational axis 25 of a gear wheel 24 and about which the drive unit 21, together with the gear wheels 24, rotates in the direction shown with arrow 31. The drive unit 21 is located in a housing 27 which is provided with an actuation member 28 for rotatably driving the drive unit 21 against a biasing force of a spring 29. The actuation member 28 is formed as a handle-shaped projection extending along the rotational axis 26 of the drive unit 21. The spring 29 is formed as a torsion spring. The drive unit 21 is secured in its position, in which it is disengaged or disconnected from the piston rods 16 by a locking lever 30 that engages in its locking condition, in a recess formed in the housing portion 20. After the release of the locking lever 30, upon displacement of the lever 30, the biasing force of the spring 29 forcefully displaces the drive unit 21 into a position in which the gear wheels 24 again engage the toothings 17 of the piston rods 16. For a manual return of the disengaged drive unit 21 in its disengaged position, the drive unit 21 is rotated about the rotational axis 26 in a direction opposite to that shown with the arrow 31 until the drive gears 24 again engage the toothings 17 of the respective piston rods 16.

Figure 4:
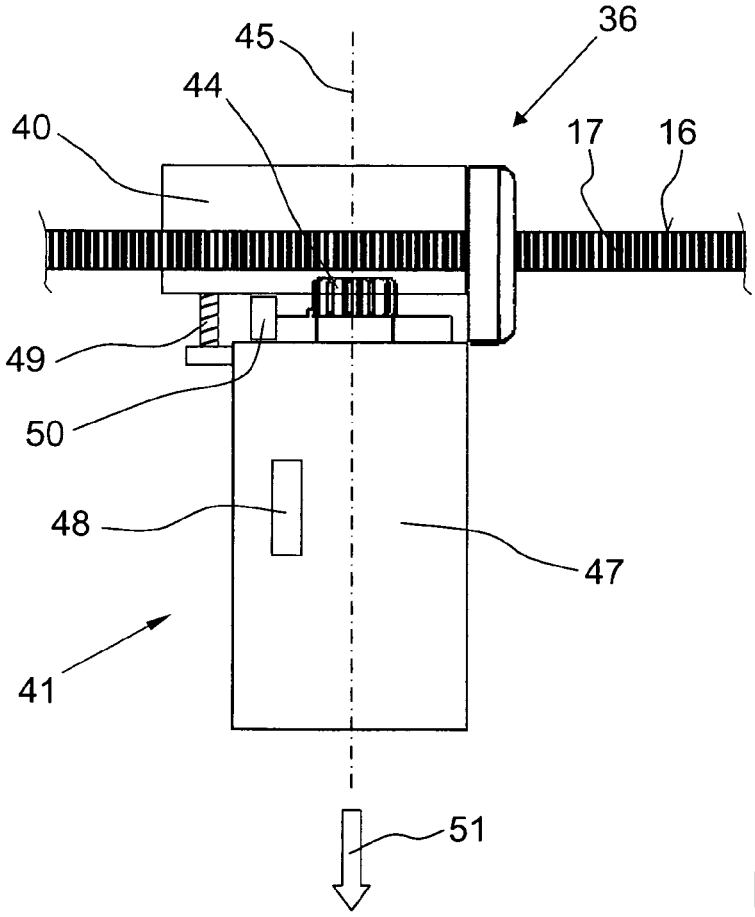
FIG. 4 a side, partially cross-sectional view of a second embodiment of an ejection device according to the present invention with a disconnected drive unit.

FIG. 4 shows, only partially, a second embodiment of the ejection device according to the present invention, the device 36. In the ejection device 36 the drive unit 41, together with gear wheels 44, are displaced along the rotational axis 45 of the gear wheel 44 in the direction of arrow 51 for disengaging the gear wheels 44 from the toothings 17 of the piston rods 16. On the housing 47 of the drive unit 41, there is provided an actuation member 48 for the axial displacement of the drive unit 41. The ejection device 36 further has a spring 49 which is formed as a helical spring and against a biasing force of which the drive unit 41 is displaced. The drive unit 41 is releasably secured in its position, in which it is disengaged from the piston rods 16, by a locking lever 50 that penetrates, in its locking position, into a gap between the drive unit 21 and a housing part 40. After release of the locking lever 50 and after the axial displacement of the drive unit 41, together with the gear wheels 44, in a direction opposite the direction shown with the arrow 51, the gear wheels 44 again engage the toothings 17 of the piston rods 16.

Though the present invention was shown and described with references to the preferred embodiments, such are merely illustrative of the present invention and is not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. An ejection device for a mass-containing package (12), comprising two piston rods (16) extending parallel to each other and spaced from each other and each having teeth (17)

extending along a longitudinal extent thereof; and a drive unit (21; 41) for displacing the two piston rods (16) and including two gear wheels (24; 44) directly engageable with respective teeth (17) of the two piston rods (16) and displaceable from a first position, in which they engage the respective teeth (17) of the two piston rods (16), to a second position in which they are disengaged from the respective teeth (17) of the two piston rods; a drive motor (22) for driving the two gear wheels (24; 44); and a common rotational axis (26) extending parallel to rotational axes (25) of respective gear wheels (24, 44) and about which the drive unit (21) rotates, together with the gear wheels (24); for displacing the gear wheels (24; 44) from the second position in which the gear wheels are disengaged from the respective teeth of the two piston rods into the first position in which the two gear wheels engage the respective teeth of the two piston rods.

2. An ejection device according to claim 1, further comprising an actuation member (28; 48) for rotatably driving the drive unit (21) together with the gear wheels (24; 44).

3. An ejection device according to claim 1, further comprising a spring (29; 49) against biasing force of which the drive unit (21), together with the gear wheels, (24; 44) is displaceable.

4. An ejection device according to claim 1, further comprising a locking lever (30; 50) for releasably securing the drive unit (21), together with the one gear wheels (24; 44) in the position in which the gear wheels (24; 44) are disengaged from the piston rods (16).

* * * * *